US012296374B2

(12) United States Patent
Christoph et al.

(10) Patent No.: US 12,296,374 B2
(45) Date of Patent: May 13, 2025

(54) METHOD FOR PRODUCING METAL COMPONENTS AND METAL COMPONENT PRODUCED IN THIS WAY

(71) Applicants: REHAU AG + Co, Rehau (DE); M.G. MECCANICA s.r.l., Prevalle (IT)

(72) Inventors: Sven Christoph, Weisendorf/Nürnberg (DE); Martin Haake, Erlangen (DE); Bernd Röder, Neuenmarkt (DE); Sergio Cocchi, Bedizzole (IT); Lorenzo Zavarise, Brescia (IT); Stefano Cocchi, Mazzano (IT)

(73) Assignees: REHAU INDUSTRIES SE & CO. KG, Rehau (DE); MG MECCANICA SRL, Prevalle (IT)

( * ) Notice: Subject to any disclaimer, the term of this patent is extended or adjusted under 35 U.S.C. 154(b) by 536 days.

(21) Appl. No.: 17/593,165

(22) PCT Filed: Mar. 11, 2020

(86) PCT No.: PCT/EP2020/056419
§ 371 (c)(1),
(2) Date: Sep. 10, 2021

(87) PCT Pub. No.: WO2020/182846
PCT Pub. Date: Sep. 17, 2020

(65) Prior Publication Data

US 2022/0016693 A1 Jan. 20, 2022

(30) Foreign Application Priority Data

Mar. 11, 2019 (DE) ..... 10 2019 106 136.9

(51) Int. Cl.
*B21J 1/06* (2006.01)
*B21J 5/02* (2006.01)
(Continued)

(52) U.S. Cl.
CPC ..... *B21J 1/06* (2013.01); *B21J 5/025* (2013.01); *C22C 9/00* (2013.01); *C21D 7/13* (2013.01)

(58) Field of Classification Search
None
See application file for complete search history.

(56) References Cited

U.S. PATENT DOCUMENTS 8,470,101 B2 6/2013 Kobayashi et al.
2012/0082588 A1 4/2012 Kobayashi et al.
(Continued)

FOREIGN PATENT DOCUMENTS

DE 202008003352 U1 8/2009
DE 102012013817 A1 1/2014
(Continued)

OTHER PUBLICATIONS

English language machine translation of EP-3225707-A1. Generated Mar. 21, 2024. (Year: 2024).*
(Continued)

*Primary Examiner* — Brian D Walck
(74) *Attorney, Agent, or Firm* — Aird & McBurney LP

(57) ABSTRACT

The invention relates to a method for producing metal components, consisting at least partially of a copper alloy, comprising the following alloy components in wt. %: 0 wt. %<Sn≤8 wt. %; 0 wt. %<Zn≤6 wt. %; 0.1 wt. %≤S≤0.7 wt. %; optionally no more than 0.2 wt. % phosphorus; optionally no more than 0.1 wt. % antimony; and optionally iron, zirconium and/or boron alone or in a combination of two or more of said elements of no more than 0.3 wt. %; and unavoidable impurities, and the rest being copper. The method comprises the following stages: (a) melting the copper alloy: (b) producing press blanks from the copper alloy; and (c) pressing the press blanks at a suitable pressing
(Continued)

temperature to form the metal components. The invention also relates to a metal component which has been produced according to a method of this type.

8 Claims, 5 Drawing Sheets

(51) Int. Cl.
*C21D 7/13* (2006.01)
*C22C 9/00* (2006.01)

(56) References Cited

U.S. PATENT DOCUMENTS

| | | | | |
|---|---|---|---|---|
| 2015/0165519 | A1* | 6/2015 | Aufrecht | C22F 1/08 420/475 |
| 2016/0130685 | A1 | 5/2016 | Huang et al. | |

FOREIGN PATENT DOCUMENTS

| | | | | |
|---|---|---|---|---|
| DE | 202016101661 | U1 | 6/2017 | |
| EP | 3225707 | A1 * | 10/2017 | C22C 9/02 |
| EP | 3581667 | A2 | 12/2019 | |
| JP | 2013199699 | A | 10/2013 | |
| RU | 2224617 | C1 | 2/2004 | |
| RU | 2482204 | C2 | 5/2013 | |
| WO | 2009109386 | A1 | 9/2009 | |

OTHER PUBLICATIONS

Standard DIN EN 15664-1 2014-03-00. "Einfluss metallischer Werkstoffe auf Wasser für den menschlichen Gebrauch-Dynamischer Prüfstandversuch für die Beurteilung der Abgabe von Metallen—Teil 1: Auslegung und Betrieb", German Version, EN 15664-1:2008+A1:2013. p. 1-33. (URL: http://perinorm/Perinorm-Volltexte/2016-11_11_Grunbestand/CD21DE_05/2025700/2025700.pdf?) [Retrieved on May 21, 2019].

Standard DIN EN ISO 2624 1995-08-00. "Kupfer und Kupferlegierungen-Bestimmender mittleren Korngröße" (ISO2624:1990); German Version, EN ISO 2624:1995. p. 1-11. (URL: http://perinorm/Perinorm-Volltexte/2016 11_Grunbestand/CD21DE_01/2791871/2791871.pdf?) [Retrieved on Mar. 6, 2017].

Standard DIN EN ISO 6506-12015-02-00. "MetallischeWerkstoffe-Härteprüfung nachBrinell—Teil 1: Prüfverfahren" (ISO 6506-1:2014); German Version EN ISO 6506-1:2014. p. 1-28.

International Bureau of WIPO, International Preliminary Report on Patentability and English Translation of the Written Opinion of the International Searching Authority in PCT/EP2020/056419, Aug. 24, 2021.

Search Report in German Patent Application DE 102019106136.9, Jan. 21, 2021.

Maruyama, Toru et al., "Influence of Alloying Elements on Sulfide Formation in Lead Free Bronze Castings with Dispersed Sulfide Particles", Materials Transactions, (2012), pp. 380-384, vol. 53, No. 2, Japan Foundry Engineering Society.

Russian Patent Office (Rospatent), English Translation of an Official Notice of Examination in corresponding Russian Patent Application No. 2021129180/05(61926).

* cited by examiner

METHOD FOR PRODUCING METAL COMPONENTS AND METAL COMPONENT PRODUCED IN THIS WAY

The present invention relates to a method for producing metal components, wherein the metal components consist at least in part of a lead-free copper alloy. Furthermore, the present invention relates to a metal component that is produced in a method of this kind.

Metal components, in particular components for media-carrying gas or water pipes, in particular fittings or valves for drinking water pipes, generally have a complex geometry. As used herein, a component is referred to as having a complex geometry when the component cannot be produced using a quasi-continuously running shaping process, such as extruding bars or pipes and rolling strips.

A wide range of metals and alloys are known as materials for use in metal components of this kind. Particularly high requirements are placed on components for water-carrying, in particular drinking-water-carrying constructions such as fittings, valves, pipes, press-fit connectors, gutters or drainage channels. Corrosion resistance should be mentioned in particular for components that are in contact with drinking water. Gunmetal should be mentioned as one of the most important types of alloy having accordingly high corrosion resistance for components of this kind, but it has the drawback that it can only be hot-formed with great difficulty.

For use in drinking water installations, the gunmetal alloy CuSn5Zn5Pb2, having a content of approximately 5 wt. % tin and approximately 5 wt. % zinc, is currently widely used. This copper alloy has excellent corrosion resistance and can therefore be used with all water qualities in the supply of drinking water. Components made of this alloy are cast and are then mechanically machined to form the end product, but the mechanical machining presents problems due to the plastic deformability of the alloy, resulting in the formation of long chips. In order for it to still be possible to machine the products in a cost-effective manner, lead is added to the alloys as a chip-breaking additive, and this allows for cost-effective, fully automated mechanical machining. However, the provisions for alloys that are used in installations for drinking water with regard to the lead content were already drastically tightened in the past. In the future, it is expected that these provisions will be tightened even further until there is a complete ban on lead in alloys of this kind.

U.S. Pat. No. 8,470,101 B2 therefore describes a lead-free gunmetal alloy having high corrosion resistance which, in addition to copper and unavoidable impurities, consists of 0.1 wt. % to 0.7 wt. % sulfur, up to 8 wt. % tin and up to 6 wt. % zinc, and in which the task of the lead as a chip breaker is performed by sulfur phases in the form of sulfide particles. Shrink holes can form through the entire wall thickness of the component when casting the material, which results in porosity of the material, which in turn can result in the component becoming permeable during the machining. Furthermore, harmful constituents of the medium to be transported may become concentrated in the cavities, and this negatively impacts the corrosion resistance.

Against this background, the problem addressed by the present invention is to provide a method for producing metal components that overcomes the drawbacks of the prior art. In particular, the metal components obtained by the method according to the invention are intended to have high corrosion resistance and high pressure tightness and to be able to be produced with low complexity.

This problem and other problems are solved by a production method for a metal component having the features of claim 1. Preferred embodiments of the method according to the invention are described in the dependent claims.

According to the present invention, it has surprisingly been found that a lead-free copper alloy that comprises, as alloy components in wt. %, in addition to copper (Cu) and unavoidable impurities, up to 8 wt. % tin (Sn), up to 6 wt. % zinc (Zn), 0.1 wt. %<sulfur (S)<0.7 wt. % and optionally up to 0.2 wt. % phosphorus (P), can be subjected to a hot-pressing process. If a press blank made of an alloy of this kind is subjected to a hot-pressing process, grain refinement takes place predominantly in the regions of the obtained workpiece that are close to the surface without additional measures being required for this purpose during the production of the copper alloy or press blank. This grain refinement in regions close to the surface of the component also has the advantage that the obtained component has increased surface hardness, which gives the component high wear resistance while the component as a whole has good toughness properties due to the higher grain size in the interior of the component. This fine-grained alloy structure is also surprisingly not disrupted by incoherent regions and, as a result, can be formed in an excellent manner. Furthermore, in particular on the surface, the fine-grained alloy structure results in greater impermeability of the metal component obtained according to the invention and in improved migration and corrosion properties. Owing to the hot-pressing process, manufacturing that is closer to the final contour is also made possible, which avoids any high-volume machining of the material starting from the surface and therefore both avoids exposing porosities and wasting a large amount of alloy.

Accordingly, the present invention lies in a method for producing metal components which consist at least in part of a copper alloy that comprises the following alloy components in wt. %:

- 0 wt. %<Sn<8 wt. %;
- 0 wt. %<Zn<6 wt. %;
- 0.1 wt. %<S<0.7 wt. %;
- optionally no more than 0.2 wt. % phosphorus; and
- optionally no more than 0.1 wt. % antimony; and
- optionally iron, zirconium and/or boron alone or in a combination of two or more of said elements no more than 0.3 wt. %; and unavoidable impurities, and copper for the remainder;

wherein the method comprises the steps of (a) melting the copper alloy; (b) producing press blanks from the copper alloy; and (c) pressing the press blanks at a suitable pressing temperature to form the metal components. Furthermore, the present invention lies in providing a metal component that is produced in the method according to the invention.

Furthermore, it could be found that an optional antimony content of at most 0.1 wt. % is non-critical with regard to the properties of the drinking water migration. The copper alloy may also optionally contain proportions of the elements iron (Fe), zirconium (Zr) and/or boron (B) alone or in a combination of at least two of said elements as grain refiners. It is preferable here for iron to be contained in a weight proportion of up to 0.3 wt. %, for zirconium to be contained in a weight proportion of up to 0.01 wt. % and/or for boron to be contained in a weight proportion of up to 0.01 wt. % in the lead-free copper alloy. These grain refiners prevent hot cracking and have a positive effect on the mechanical properties, such as tensile strength, material hardness and the like.

As used herein, the term "metal component" is in particular understood to mean components made of metals and alloys. Metal components produced according to the invention may for example be motor-vehicle accessory parts and electrical and electronic components, such as blocking rings, nozzles, bearing shells, cable clips, holders, screws, plug connections, contact springs, system carriers and the like; musical instruments, such as horns, bells, cymbals, harmonicas, trumpets, saxophones and the like; components for heating, ventilation and air-conditioning systems, such as motor parts, nozzles and the like; fittings for construction purposes, such as handrails, door handles, decorative ornaments, light switches, towel rails; hinges for windows and doors, fittings for windows and doors, strike plates for windows and doors, door sills, windowsills and the like; valves, hydraulic fittings and the like for mechanical engineering; blades and column cladding for wind turbines and the like; components for ships, submarine pipelines, such as compasses, bells and the like; medical devices, such as surgical instruments, nozzles, valves and the like; capacitor plates, heat exchangers, pump shafts, pump housings; garden accessories, such as hose couplings, spray guns, showers, sprinklers and the like; accessories such as keyrings, belt buckles, jewelry and the like; art objects, such as masks, animal figures, jewelry and the like; as well as components for media-carrying gas or water pipes, in particular fittings or valves for drinking water pipes. According to the invention, however, components for media-carrying gas or water pipes, in particular fittings or valves for drinking water pipes, are preferred. As used herein, the term "component for media-carrying gas or drinking-water pipes" is in particular understood to mean those components which come into contact with water, in particular drinking water, in a domestic installation pipe system, with fittings and valves of such domestic installation pipe systems being preferred according to the invention. The component for media-carrying gas or drinking-water pipes may be a threaded shaped part or a threadless shaped part. This in particular includes connectors, connection pieces, connection brackets, multi-port distributors, T pieces, wall T pieces, wall brackets, system transitions, transition pieces and angled transition pieces, which each optionally may comprise at least one thread. In particular the connector known from EP 2 250 421 A1 can be mentioned as an example of such a component for media-carrying gas or drinking-water pipes.

Furthermore, the term "region close to the surface", as used herein, is understood to mean the region of a component which is up to at least 200 μm, preferably up to at least 100 μm, below the surface of the component. It is clear here that these grain sizes are only present in portions of the component which have actually also undergone forming due to the pressing step.

The press blanks made of the copper alloy that are used in the method according to the invention may in particular be portions that have been cut to length and are made of bar stock or hollow bar stock of the copper alloy.

The sulfur content of the copper alloy used in the method according to the invention is preferably 0.2 wt. % to 0.65 wt. %. Owing to the hot-forming process, the sulfide particles orient themselves in the forming direction to a particularly great extent at a sulfur content in this preferred range. At a sulfur content of less than 0.20 wt. %, the problem may arise that sufficient chip breakage can no longer be produced because the distances between the individual particles may be too large in certain circumstances. As a result, burrs may develop, which have to be removed in additional work steps. At a sulfur content of greater than 0.65 wt. %, the reduced distances between the individual particles in the forming direction lead to two effects: first of all, the offsets may no longer be able to move unhindered through the matrix, and material separation may occur at the sulfide particles during the hot-forming process. In addition, the component produced according to the invention may have a lower strength, which can impair the service life of the component. Furthermore, a sulfur content of greater than 0.65 wt. % sulfur can result in deterioration of the mechanical characteristic values, such as elongation at break. Further improved properties have been obtained with an alloy of which the sulfur proportion is in the range of from 0.23 wt. % to 0.45 wt. %, in particular in the range of from 0.25 wt. % to 0.35 wt. %. Owing to the alloy composition used according to the invention, with such a sulfur content, the metal sulfides are present in the lead-free copper alloy as incoherent, finely distributed, disperse phases in the form of finely distributed particles. This provides the advantage that any potential corrosion only occurs to a limited extent locally to these particles, and not along cohesive, larger, individual phases of the alloy structure, as is the case for standard brass, for example. Owing to the small size of the particles and the structure that is highly closed compared with the cast component (no shrink holes or the like), no significant corrosive attack takes place.

The zinc content of the copper alloy used in the method according to the invention is preferably 1.3 wt. % to 3.5 wt. %, particularly preferably a zinc content is in the range from 2.0 wt. % to 3.0 wt. %. At a zinc content in this range, homogeneous distribution of the particles in the alloy structure can be ensured. Furthermore, in this range, the zinc brings about improved flowability of the material during the deformation process. The zinc content of max. 3.5 wt. % zinc additionally ensures that partial corrosion can be prevented and particularly high corrosion resistance can be obtained. Further improved results can be obtained at a zinc content of from 1.5 wt. % to 3.3 wt. %, particularly preferably of from 2.0 wt. % to 3.0 wt. %.

The proportion of phosphorus (P) in the lead-free copper alloy is preferably at least 0.001 wt. %, in particular 0.015 wt. % to 0.1 wt. %. Below 0.015 wt. % phosphorus, it is possible that sufficient deoxidation of the melt does not take place, which could have a negative effect on the phase formation of the alloy. By contrast, with a phosphorus proportion of greater than 0.1 wt. %, the copper alloy tends to have unfavorable effects on the mechanical properties, such as reduced elongation at break. From this viewpoint, the weight proportion of phosphorus in the lead-free copper alloy is preferably in the range of from 0.02 wt. % to 0.08 wt. %, particularly preferably in the range from 0.04 wt. % to 0.06 wt. %.

The tin content of the copper alloy used in the method according to the invention is preferably in a range of from 3.0 wt. % to 4.8 wt. %, in particular in a range of from 3.0 wt. %<Sn<4.5 wt. %. In this range, a balanced, cost-effective relationship between strength, corrosion resistance and phase distribution is obtained. At a tin content in the range of from 3.0 wt. % to 4.8 wt. %, particularly good results are obtained with regard to elongation at break and corrosion resistance.

Furthermore, at a tin content in the range of from 3.0 wt. % to 4.8 wt. %, the method according to the invention can be carried out particularly cost-effectively with regard to forming speed and forming force. Dynamic strain ageing may occur when carrying out the method according to the invention. This may occur in particular when the diffusion speed of the tin atoms during the forming process is the same as the speed of the migration of the crystal defects. The occurrence of dynamic strain ageing may be avoided by suitable forming speeds and forming forces when carrying out the method according to the invention. In this case, a tin content in the range of from 3.5 wt. % to 4.0 wt. % can provide particularly good results. In this respect, this preferred range is an ideal compromise between corrosion resistance and producibility.

Preferably, the copper content of the lead-free copper alloy is at least 90 wt. %, particularly preferably greater than 92 wt. %. It has been found that such a copper content allows for good processability in combination with good corrosion resistance.

The copper alloy used in the method according to the invention is preferably a lead-free copper alloy. As used herein, the term "lead-free copper alloy" means a copper alloy that in particular contains lead as an unavoidable impurity in a quantity of no more than 0.25 wt. %, but preferably no more than 0.10 wt. %, particularly preferably no more than 0.05 wt. %. In the alloy, the lead proportion is at most 0.25 wt. %, preferably at most 0.10 wt. %, and particularly preferably at most less than or equal to 0.05 wt. %. When investigating the lead migration in accordance with the DIN EN 15664-1 standard, the alloy does not exhibit any signs of increased lead release in the first weeks. Instead, from the eighth week of investigation, no further significant lead migration into the drinking water can be identified or is in the range of the measurement accuracy of the method. The nickel proportion as an unavoidable impurity in the alloy used according to the invention is at most 0.4 wt. %, preferably at most 0.3 wt. %. The addition of nickel increases the corrosion resistance of the alloy without being contradictory to hygienic safety. Similarly to lead, the values for the nickel migration in an investigation in accordance with the DIN EN 15664-1 standard are far below the legally required limit.

It may be of use for the pressing temperature in step (c) to be in a range of from 750° C. to 900° C., preferably in a range of from 800° C. to 880° C. Below a pressing temperature of 750° C., it cannot be reliably ensured that fine-grain formation takes place. Furthermore, in this range considerably higher forming forces are required to manufacture a component. On one hand, this may result in quality problems due to regions that are not properly formed and, on the other hand, the forming is no longer cost-effective. Above a pressing temperature of 900° C., first liquid phases develop along the grain boundaries of the copper alloy, which results in hot cracking and unfavorable grain-boundary configurations in the material. In the preferred range for the pressing temperature of from 800° C. to 880° C., a particularly homogeneous, fine-grained structure is produced and the risk of hot cracking is minimized. At pressing temperatures in a range of from 815° C. to 850° C., dynamic strain ageing of the alloy can be particularly effectively prevented.

It may also be advantageous for the press blanks to be heated to the pressing temperature before step (c) and to be kept at the pressing temperature over a period of time of from 0.1 seconds to 60 minutes, preferably of from 2 seconds to 10 minutes. If the press blanks are kept at the pressing temperature over said period of time before pressing, it is ensured that the entire press blank has reached a homogeneous temperature and a uniform pressing process can thus take place.

It may also prove to be advantageous for the copper alloy in the component to have a structure having an average grain size of less than 100 μm in a region close to the surface after the hot-pressing process. As a result, the migration behavior and the corrosion resistance of the components produced according to the invention are further improved. Preferably, the copper alloy in the component has a structure having an average grain size of from 10 μm to 70 μm, in particular of from 20 μm to 60 μm, in the region close to the surface after the hot-pressing process.

In relation to the metal component according to the invention, it has proven advantageous for the metal component according to the invention to have a wall thickness at least in portions in the range from 0.5 mm to 6.0 mm, since the thin wall thickness results in cooling rates that are suitable for forming the copper sulfides, which are favorable for the migration behavior. Furthermore, it is preferable for the entire metal component according to the invention to have a wall thickness within the stated ranges of from 0.5 mm to 4.0 mm, since a wall thickness in this range results in particularly increased formation of the desired sulfide particles. A wall thickness of below 0.5 mm may not have sufficient mechanical strength of the metal component according to the invention, owing to the small cross section. From this viewpoint, it is preferable for the metal component according to the invention to have a wall thickness at least in portions in the range of from 1.0 mm to 4.0 mm.

Furthermore, the copper alloy in the metal component according to the invention has a structure having an average grain size of less than 100 μm in a region close to the surface. This contributes to very good migration behavior and to high corrosion resistance of the metal components according to the invention. At the same time, a pressure-tight structure can be ensured thereby. The pressure-tight structure results, inter alia, from closure of possible cavities and shrinkage owing to the high pressures and temperatures introduced during closed die forging. The material is simultaneously homogenized and possible differences in the grain sizes are compensated for, and this likewise improves the mechanical properties. Preferably, the copper alloy in the component has a structure having an average grain size of from 10 μm to 70 μm, in particular of from 20 μm to 60 μm, in the region close to the surface after the hot-pressing process.

It may be advantageous for the metal component according to the invention to be a component for media-carrying gas or water pipes, in particular a fitting or valve for drinking water pipes.

The metal component produced according to the invention has a pressure-tight structure with improvements in terms of the corrosion resistance. By contrast with a cast part, in which surface abrasion can also begin in the bottom of a shrink hole and is potentially intensified by substances becoming concentrated therein, in the present production method having a step of hot forming, the surface attack is only apparent starting from the surface. This also makes it possible to construct significantly more delicate components having increased mechanical demands. Possible segregations are also homogenized during hot pressing, and therefore differences in concentration and possible tin depletion cannot occur. This can prevent a possible corrosive attack.

In the following, the present invention will be explained in greater detail with reference to embodiments and tests carried out therewith, and to accompanying drawings. It is clear that these examples should not be considered to limit the invention in any way. Unless stated otherwise, all the percentages and stated proportions are by weight in the present application, including the claims.

LABORATORY TEST OF THE FORMING BEHAVIOR

In order to simulate the forming behavior, closed-die-forging tests were carried out on a laboratory scale. A pipe having the dimensions 23 mm×8 mm was used as the starting material. The semi-finished product was produced from a copper alloy in a continuous casting process, with the proportions of the components in the copper alloy being stated in wt. % in table 1 below.

TABLE 1

| Alloy composition | | | | | | | | | | | |
|---|---|---|---|---|---|---|---|---|---|---|---|
| Alloy | Cu | Zn | Pb | Sn | P | S | Fe | Ni | Si | Sb | Al |
| 1 | 94.2 | 1.4 | 0.02 | 3.87 | 0.04 | 0.42 | 0.01 | 0.01 | 0.01 | 0.01 | 0.01 |

The half-moon-shaped test bodies were produced by slices having a thickness of approximately 5 mm being cut from the pipe and the slices being cut through the center. The test bodies thus obtained were placed into the die with the round side at the top. The die is a cube-shaped tool made of solid steel. It has a cross-shaped cut-out on the upper face, and the test body to be tested was placed into this cut-out.

The test body received in the die was placed into a furnace for the heating time stated in table 2 and was heated therein to the forming temperature also stated in table 2. For the forming, the test body received in the die was removed from the furnace, placed on an anvil, and was formed by being struck with a sledgehammer having a mass of 5 kg. The number of hammer strikes is stated in table 2. Owing to the half-moon-shaped geometry and the cut-out in the internal diameter of the pipe, forming took place in every case. After the forming, the sample was cooled with water in order to conserve and evaluate the resulting state of the structure. The formed samples were then metallographically prepared and evaluated in the region of the forming. The grain sizes were determined in accordance with DIN EN ISO 2624 using the linear intercept method.

The test conditions are summarized in table 2 below:

TABLE 2

| Test conditions | | | |
|---|---|---|---|
| Sample number | Forming temperature [° C.] | Heating time [min] | Number of strikes (deformation) |
| 1 | 800 | 90 | 2 |
| 2 | 800 | 30 | 1 |
| 3 | 830 | 75 | 1 |
| 4 | 830 | 75 | 1 |
| 5 | 860 | 65 | 1 |
| 6 | 860 | 65 | — |
| 7 | 800 | 60 | — |
| 8 | 800 | 60 | — |
| 9 | 830 | 60 | — |
| 10 | 830 | 60 | — |
| 11 | 860 | 60 | — |
| 12 | 860 | 60 | — |
| 13 | 600 | 60 | — |
| 14 | 600 | 60 | — |
| 15 | 600 | 60 | 1 |
| 16 | 600 | 60 | 1 |
| 17 | 700 | 60 | 1 |
| 18 | 700 | 60 | 1 |
| 19 | 700 | 60 | — |
| 20 | 700 | 60 | — |
| 21 | 950 | 60 | 1 |
| 22 | 950 | 60 | 1 |
| 23 | 950 | 60 | 1 |
| 24 | 950 | 60 | — |

Figure 1:
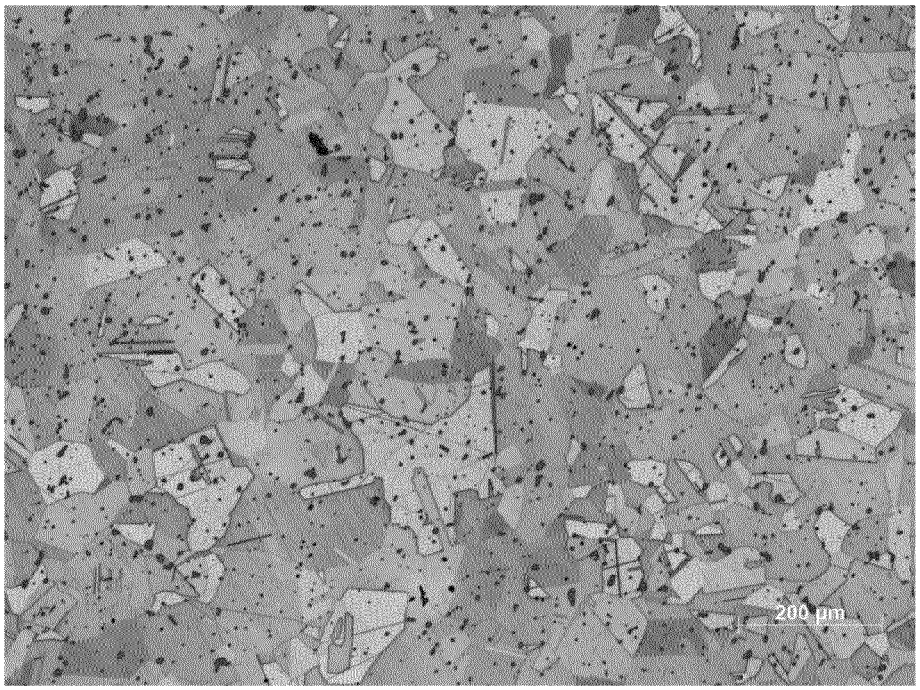
FIG. 1 shows a cross-sectional image of the structure of a formed test body made of alloy 1.

In the tests, it was possible to establish that very positive forming properties became apparent in the range between 800 and 860° C. and that the described fine-grain formation took place. If the temperatures were in a lower range, hardly any further forming would be obtained. If they were in a higher range, fused points and reticulated sulfide agglomerates would be visible. FIG. 1 shows a cross-sectional image of the structure of a test body that was formed at 830° C. in the laboratory test (sample 3). The formed structure has a reduced average grain size of approximately 45 μm. The grain size of the test body before the forming corresponds to that of a cast component, approximately 540 μm.

Figure 2:
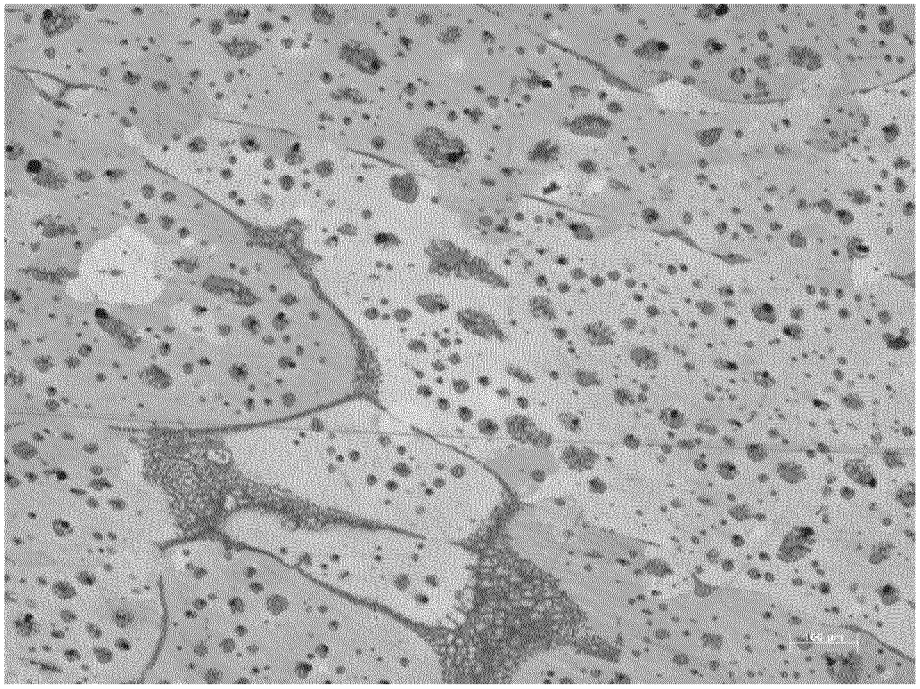
FIG. 2 shows a cross-sectional image of the structure of another formed test body made of alloy 1.

FIG. 2 (sample 21) shows a cross-sectional image of the structure of another formed test body that was formed by a hammer strike at approximately 950° C. As FIG. 2 shows, the structure of the test body has fused regions in the structure, which can be attributed to the high forming temperature of approximately 950° C. The average grain size is approximately 140 μm here. The present component exhibits hot cracks and sulfide particles that are unfavorably distributed in the structure. This is a state that cannot be used in the actual component.

Investigation of a Pressed Component with Regard to the Grain-Size Distribution

In order to simulate the producibility of a pressed component in an actual manufacturing process, some typical components of a drinking water installation were manufactured. Inter alia, a wall bracket was produced, which is shown in the photograph according to FIG. 3.

The copper alloy used for pressing the wall bracket had the proportions of the components stated in wt. % in table 3 and table 4 below.

TABLE 3

| Alloy composition | | | | | | | | | | | |
|---|---|---|---|---|---|---|---|---|---|---|---|
| Alloy | Cu | Zn | Pb | Sn | P | S | Fe | Ni | Si | Sb | Al |
| 2 | 94.9 | 1.6 | 0.05 | 3.2 | 0.01 | 0.19 | 0.01 | 0.02 | 0.01 | 0.00 | 0.01 |

TABLE 4

| Other alloy compositions | | | | | | | | | |
|---|---|---|---|---|---|---|---|---|---|
| Alloy | Cu | Zn | Pb | Sn | P | S | Fe | Ni | Remainde |
| 3 | 95.1 | 1.5 | 0.01 | 3.1 | 0.00 | 0.26 | 0.01 | 0.01 | 0.03 |
| 4 | 95.1 | 1.6 | 0.01 | 3.0 | 0.04 | 0.25 | 0.02 | 0.01 | 0.04 |
| 5 | 95.2 | 1.6 | 0.01 | 2.9 | 0.03 | 0.24 | 0.02 | 0.01 | 0.03 |
| 6 | 95.1 | 1.6 | 0.01 | 3.0 | 0.02 | 0.25 | 0.01 | 0.01 | 0.04 |
| 7 | 93.6 | 1.6 | 0.02 | 4.5 | 0.01 | 0.24 | 0.02 | 0.01 | 0.04 |
| 8 | 93.8 | 1.6 | 0.01 | 4.0 | 0.03 | 0.43 | 0.01 | 0.01 | 0.04 |
| 9 | 95.4 | 1.3 | 0.01 | 3.0 | 0.01 | 0.16 | 0.01 | 0.01 | 0.03 |
| 10 | 95.5 | 1.3 | 0.01 | 3.0 | 0.01 | 0.14 | 0.01 | 0.01 | 0.03 |
| 11 | 94.5 | 1.3 | 0.01 | 3.9 | 0.02 | 0.15 | 0.01 | 0.00 | 0.03 |
| 12 | 94.7 | 1.2 | 0.01 | 3.9 | 0.01 | 0.15 | 0.01 | 0.00 | 0.03 |
| 13 | 94.3 | 1.5 | 0.01 | 3.9 | 0.03 | 0.15 | 0.01 | 0.00 | 0.04 |
| 14 | 93.9 | 1.5 | 0.02 | 4.1 | 0.04 | 0.46 | 0.01 | 0.00 | 0.03 |
| 15 | 93.9 | 1.5 | 0.02 | 4.0 | 0.02 | 0.46 | 0.01 | 0.00 | 0.03 |
| 16 | 94.0 | 1.5 | 0.02 | 4.0 | 0.02 | 0.46 | 0.01 | 0.00 | 0.02 |
| 17 | 92.4 | 3.1 | 0.02 | 4.0 | 0.04 | 0.43 | 0.02 | 0.00 | 0.03 |
| 18 | 92.4 | 3.0 | 0.02 | 4.0 | 0.04 | 0.43 | 0.02 | 0.00 | 0.03 |
| 19 | 94.9 | 1.6 | 0.01 | 3.0 | 0.05 | 0.44 | 0.01 | 0.00 | 0.02 |
| 20 | 95.3 | 1.3 | 0.01 | 2.9 | 0.02 | 0.46 | 0.01 | 0.00 | 0.03 |
| 21 | 95.4 | 1.2 | 0.01 | 2.9 | 0.01 | 0.45 | 0.01 | 0.00 | 0.02 |

For the production of the wall bracket, continuously cast bars were produced from the above-mentioned material and were cut to length to form press blanks. The press blanks were then heated to a pressing temperature of approximately 830° C. in a preheating furnace. From the preheating furnace, the heated blanks were then slid into a preheated die in which the components were produced by closing the die.

The pressed parts thus obtained were then cooled. In a final step, the components underwent final processing and were provided with a through-hole and a thread.

Figure 3:
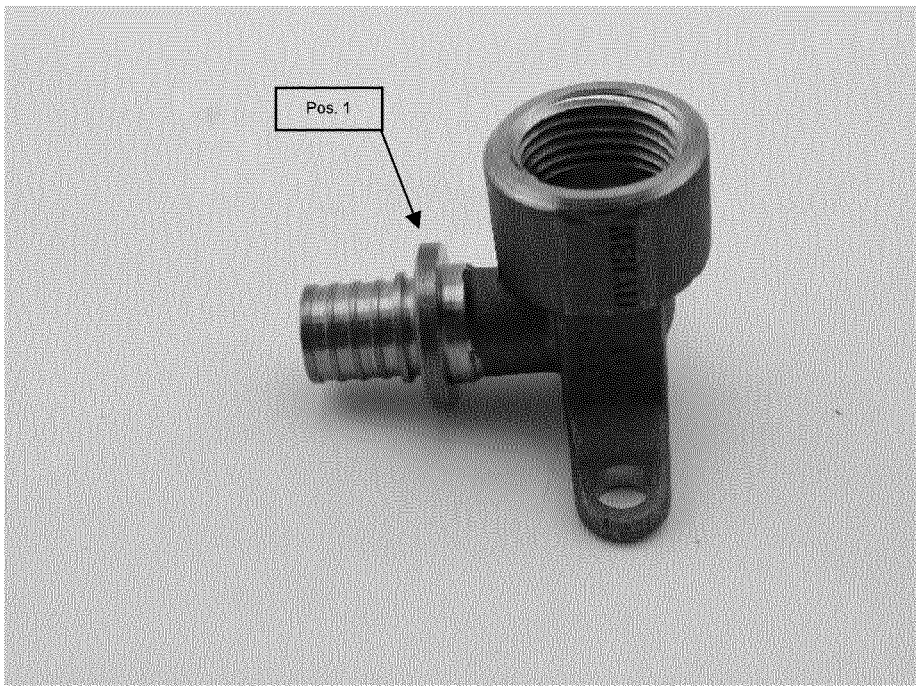
FIG. 3 is a photograph of an embodiment of a metal component according to the invention formed as a wall bracket, made of alloy 2.
Figure 4:
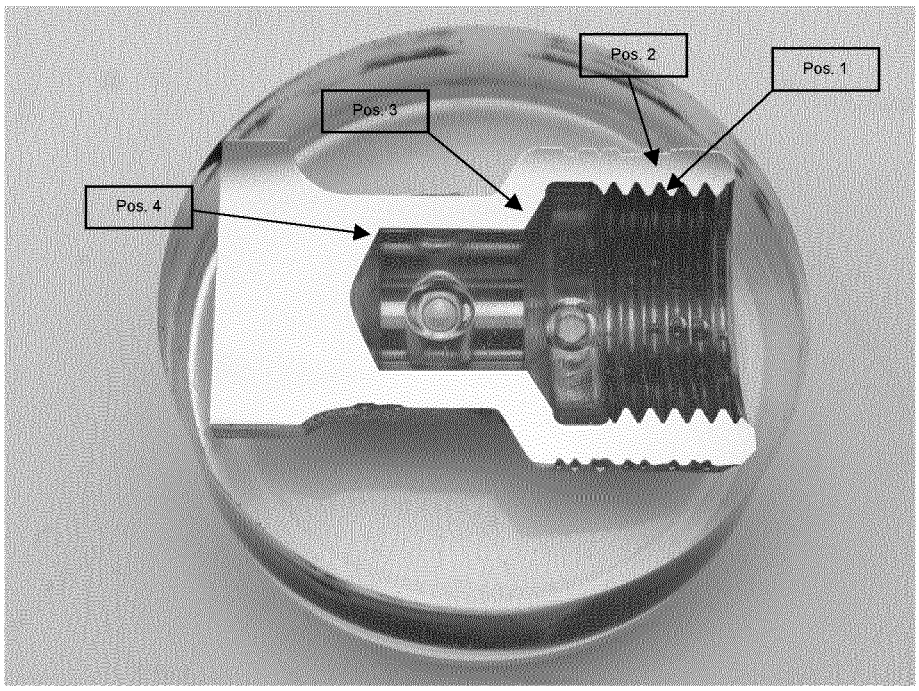
FIG. 4 is a photograph of an overview of the cross section of the structure of the metal component according to the invention shown in FIG. 3, made of alloy 2.
Figure 5:
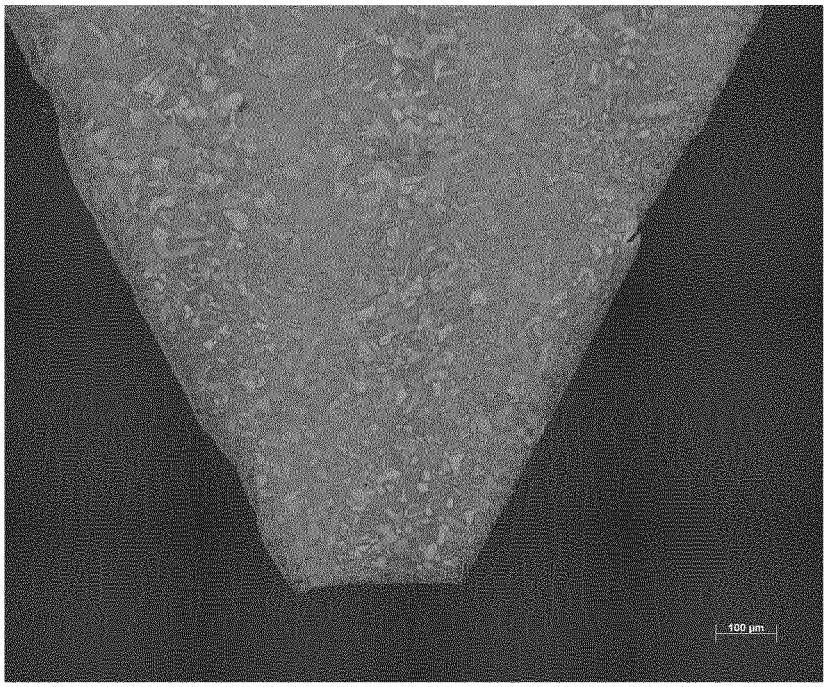
FIG. 5 shows an enlarged detail of the overview of the metal component according to the invention shown in FIG. 4, made of alloy 2.
Figure 6:
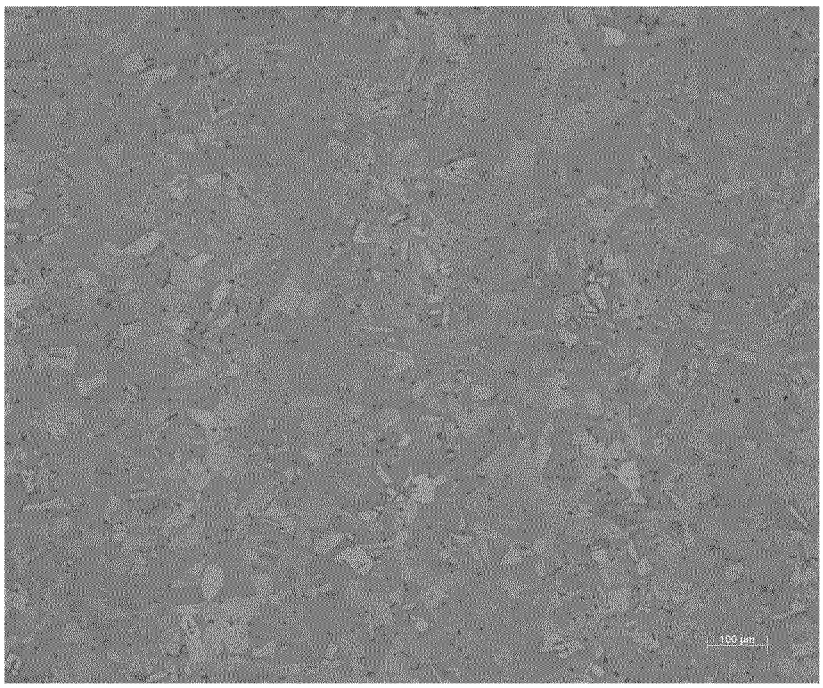
FIG. 6 shows another enlarged detail of the overview of the metal component according to the invention shown in FIG. 4, made of alloy 2.
Figure 7:
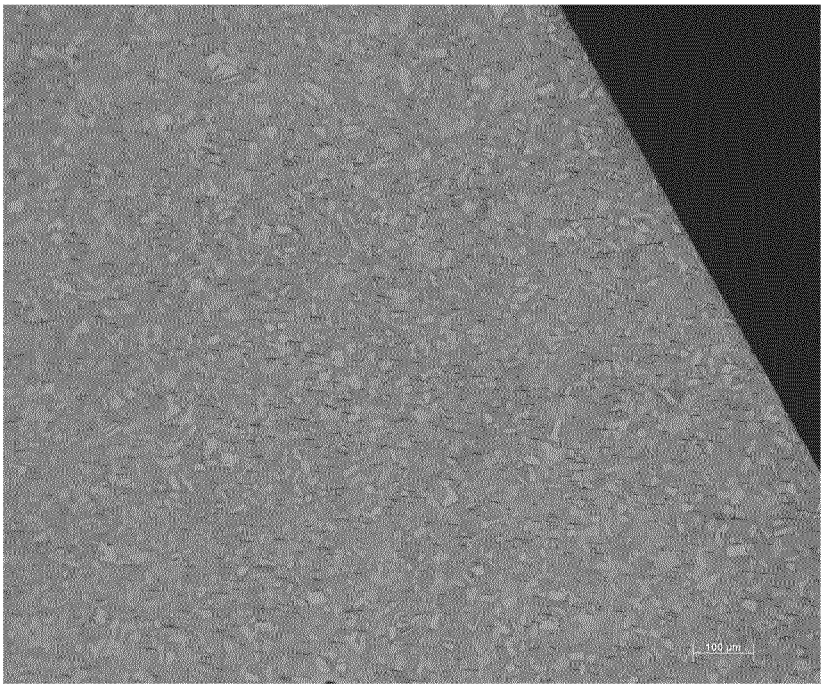
FIG. 7 shows another enlarged detail of the overview of the metal component according to the invention shown in FIG. 4, made of alloy 2.
Figure 8:
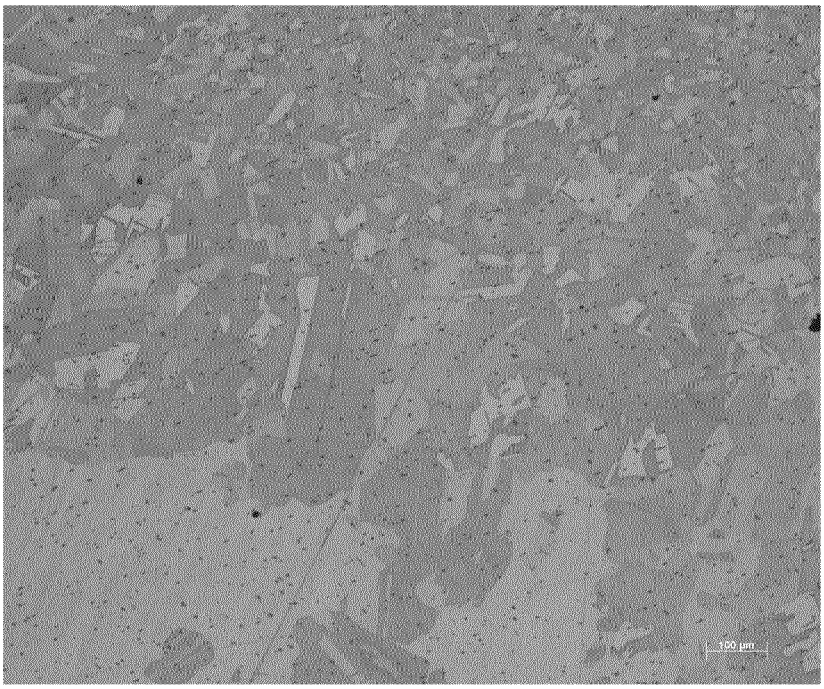
FIG. 8 shows another enlarged detail of the overview of the metal component according to the invention shown in FIG. 4, made of alloy 2.

FIG. 4 shows an overview of the cross section of the structure through the pressed wall bracket shown in FIG. 3, produced from alloy 2. The different positions in this figure show critical regions of the formed part. In FIG. 5 (position 1), the threaded region having a particularly fine-grained structure can be seen. The lower part of the image shows the inside coming into contact with the medium, which, when the component according to the invention is used as intended, comes into contact with the medium, in particular with water. The increased strength of the pressure-tight structure in the threaded region comes into effect here. As a result, less deformation occurs in the highly loaded thread region and the component has better sealing. FIG. 6 (position 2) shows the inner region behind the threaded ridge from FIG. 4. The grain size increases at this point, such that greater toughness is provided. FIG. 7 (position 3) also shows this type of structure formation in another region. This is positioned at the base of the thread, at the transition to the tapered portion of the component. The average grain size is approximately 25 μm here. Particularly in order to prevent erosive wear, the surface hardness, which is increased due to the low average grain size, is advantageous in this region. FIG. 8 (position 4) illustrates the region in which the component according to the invention has been drilled out for the transition to the outlet. Essentially, the press blank is still in the original state of the alloy here, i.e. before the pressing process, which can absorb any mechanical forces that occur here in the form of offsets, where necessary. These may constitute a particularly highly loaded region during on-site assembly, primarily when aligning the wall bracket for a valve, with the tough core thereof being highly advantageous.

This demonstrates that the material hardness in the deformed regions can be significantly increased as a rule. In the present example, in the collar region (see position 1 in FIG. 3) the hardness was able to be significantly increased to a hardness of 78 HBW 2.5/62.5 in accordance with DIN EN ISO 6506-1 compared with a structurally identical wall bracket made in a sand-casting process.

For the other lead-free copper alloys from table 4, components pressed according to the invention having likewise improved properties, such as the material hardness in the deformed regions, are obtained.

Determining the Corrosive Behavior of a Copper Alloy in Contact with an Aqueous Medium of Components Produced in a Closed-Die-Forging Process In order to evaluate the corrosion resistance, components produced using closed die forging were subjected to an artificial-ageing test, as described in the laid-open publication DE 10 2017 100896 A1.

For these artificial-ageing tests, a lead-free copper alloy was used, inter alia, with the proportions of the individual alloy components being stated in wt. % in table 5 below.

TABLE 5

| Alloy composition | | | | | | | | | | | |
|---|---|---|---|---|---|---|---|---|---|---|---|
| Alloy | Cu | Zn | Pb | Sn | P | S | Fe | Ni | Si | Sb | Al |
| 22 | 94.78 | 1.66 | 0.00 | 3.27 | 0.01 | 0.20 | 0.01 | 0.02 | 0.00 | 0.01 | 0.00 |

In order to produce test bodies, a 16 Rp ½ wall bracket for on-site use was manufactured from the alloy. The mechanical processing of the components took place under near-series conditions. To do this, the surfaces were manufactured to have comparable roughness depths, for example. In order to obtain the test bodies, the components were then cut in half. The surface of the test bodies was cleaned with acetone. In order to generate a zero level for the measurement, the components were then coated on the underside and were cleaned once more in the uncoated test region. The test bodies were then inserted into a test container so as to hang freely. The test containers were then placed into a heating cabinet at 90° C. for five months, with the test medium being changed at intervals of seven days.

Twenty-one different aqueous test media or test waters having different pHs and acid capacities were used as test media. Furthermore, different contents of chloride ions and/or sulfate ions were set by the addition of sodium chloride and/or sodium sulfate. The contents can be found in table 6.

TABLE 6

| Water number | pH | Carbonate hardness in °dH | Chloride in mg/l | Sulfate in mg/l |
|---|---|---|---|---|
| 1 | 9 | 0.5 | 10 | — |
| 2 | 9 | 0.5 | 100 | — |
| 3 | 9 | 0.5 | 250 | — |
| 4 | 9 | 0.5 | 1000 | — |
| 5 | 8 | 1.5 | 15 | — |
| 6 | 8 | 1.5 | 60 | — |
| 7 | 8 | 1.5 | 140 | — |
| 8 | 8 | 3.0 | 30 | — |
| 9 | 8 | 3.0 | 100 | — |
| 10 | 8 | 5.5 | 80 | — |
| 11 | 8 | 5.5 | 120 | — |
| 12 | 8 | 5.5 | 250 | — |
| 13 | 7 | 9.0 | 100 | — |
| 14 | 7 | 9.0 | 160 | — |
| 15 | 7 | 14.0 | 140 | — |
| 16 | 7 | 18.0 | 40 | — |
| 17 | 7 | 18.0 | 100 | — |
| 18 | 7 | 18.0 | 250 | — |
| 19 | 9 | 0.5 | 250 | 250 |
| 20 | 8 | 5.5 | 250 | 250 |
| 21 | 7 | 18.0 | 250 | 250 |

After the five-month test period, the test containers were removed from the heating cabinet and cooled to room temperature, the test bodies were removed from the respective test containers, were dried and cut open, and the cut surface was inspected with a light microscope after corresponding processing.

By comparison with a component cast from alloy 22, a component hot-pressed from alloy 22 exhibits yet further improved attack resistance. This is primarily justified by the denser structure. Because there are no shrink holes and no porosity, the medium acts on the hot-pressed component from the surface in a planar manner and very quickly forms a protective, adhering, closed cover layer. As in the cast component, this layer is virtually free of faults or defects and therefore imparts its full protection by preventing any attack at the bottom of any porosity.

Figure 9:
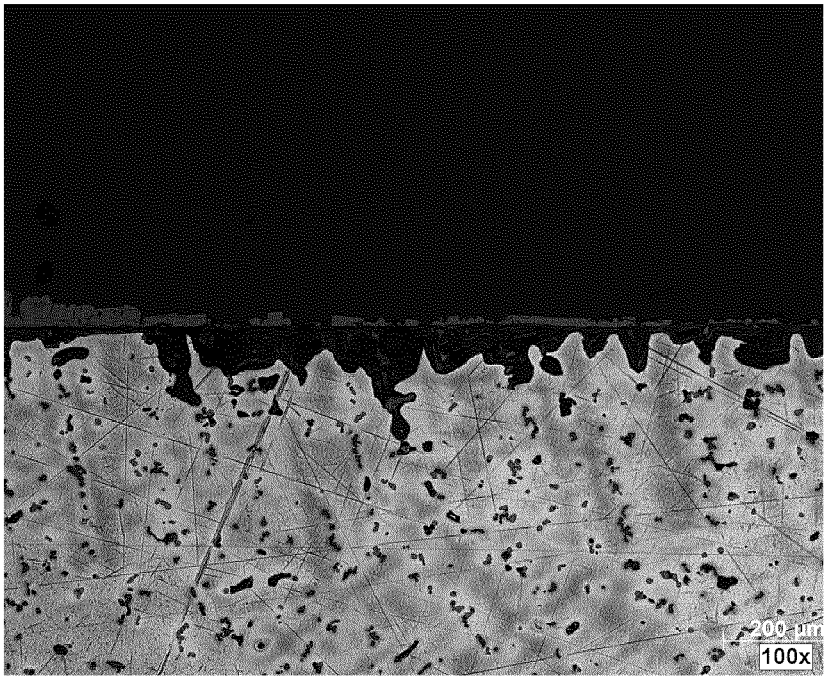
FIG. 9 is a photograph of a component that has been cast and therefore is not according to the invention, made of alloy 22 according to table 5, showing an example of a possible shrink hole and the deeper attack point in the artificial-ageing test (based on Turner, with a chloride content of 250 mg/l and a carbonate hardness of 5.5° dH)
Figure 10:
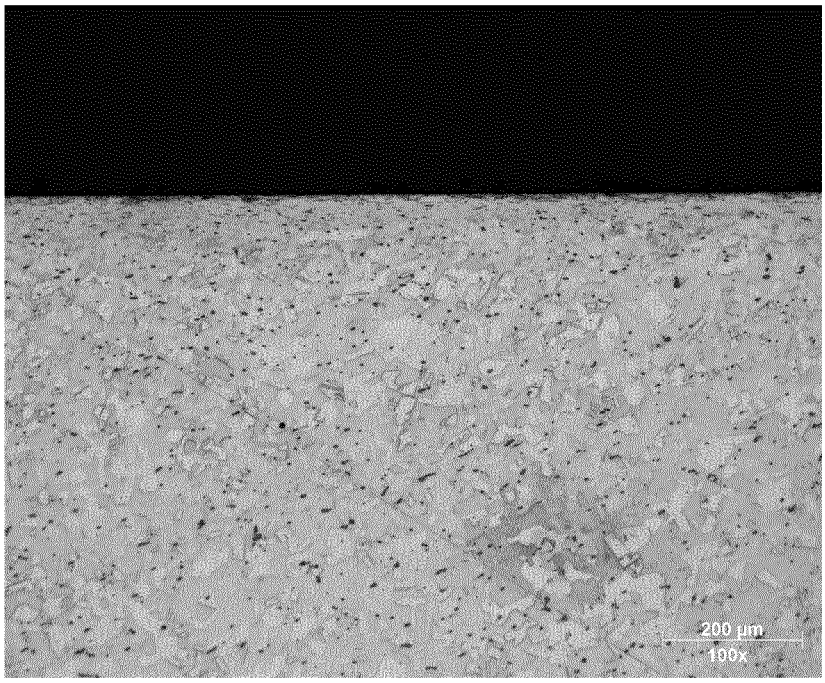
FIG. 10 is a photograph of a metal component produced according to the invention, made of alloy 22 according to table 5, showing an example of a homogeneous surface having a protective-layer structure in the artificial-ageing test (based on Turner, with a chloride content of 250 mg/l and a carbonate hardness of 5.5° dH).

FIG. 9 shows a component conventionally cast from alloy 22 that has undergone attacks that continue into the depth along pores, which component was tested at a carbonate hardness of 5.5° dH and a chloride content of 250 mg/l in the artificial-ageing test. By comparison therewith, FIG. 10 shows a component made of alloy 22 hot-pressed according to the invention, which component was tested with an identical material composition under the same test conditions during the artificial-ageing test. By contrast with the component from FIG. 9, there are no pores at all in the hot-pressed component. The medium therefore attacks the surface homogeneously and the attacks are therefore considerably less pronounced. The corrosive behavior is positively influenced by the hot pressing, as shown in FIG. 10.

In the above, the present invention has been described with reference to examples and comparative examples; however, it is clear to a person skilled in the art that the invention is not restricted to these examples, but instead the scope of the present invention results from the accompanying claims.

The invention claimed is:

1. A method for producing a metal component which comprises a copper alloy that comprises the following alloy components in wt. %:

3.0 wt. %<Sn<8 wt. %;

1.3 wt. %<Zn<6 wt. %;

0.1 wt. %<S<0.7 wt. %;

no more than 0.2 wt. % phosphorus;

no more than 0.1 wt. % antimony; and iron, zirconium and/or boron alone or in a combination of two or more of said elements no more than 0.3 wt. %; and unavoidable impurities, and copper for the remainder;

wherein the method comprises the following steps:

(a) melting the copper alloy;

(b) producing press blanks from the copper alloy; and (c) pressing the press blanks at a suitable pressing temperature in a range of from 750° C. to 900° C. to form the metal component, and wherein the pressing step reduces an average grain size of a structure of the copper alloy in the metal component from greater than 100 μm to less than 100 μm in a region up to 200 μm below the surface of the metal component, while leaving an average grain size of the structure as greater than 100 μm in another region more than 200 μm below the surface of the metal component.

2. The method according to claim 1, characterized in that the proportion of sulfur in the alloy is 0.20 wt. %<S<0.65 wt. %.

3. The method according to claim 1, characterized in that the proportion of zinc in the alloy is 1.3 wt. %<Zn<3.5 wt. %.

4. The method according to claim 1, characterized in that the proportion of phosphorus in the alloy is 0.015 wt. %<P<0.1 wt. %.

5. The method according to claim 1, characterized in that the content of the proportion of tin in the alloy is 3.0 wt. %<Sn<4.8 wt. %.

6. The method according to claim 1, characterized in that copper is contained in the lead-free copper alloy in a quantity of greater than 90 wt. %.

7. The method according to claim 1, characterized in that the pressing temperature in step (c) is in a range of from 800° C. to 880° C.

8. The method according to claim 1, characterized in that the press blanks are heated to the pressing temperature before step (c) and are kept at the pressing temperature over a period of time of from 0.1 seconds to 60 minutes.

* * * * *